US006019479A

United States Patent [19]

Barker

[11] Patent Number: 6,019,479

[45] Date of Patent: Feb. 1, 2000

[54] MULTI-FASTENING, ONE-PIECE, DECORATIVE FAN BLADE COVER AND STROBE LIGHT

[76] Inventor: Dale E. Barker, 1318 State St., Alton, Ill. 62002

[21] Appl. No.: 08/936,417

[22] Filed: Sep. 25, 1997

Related U.S. Application Data

[60] Provisional application No. 60/027,474, Sep. 26, 1996.

[51] Int. Cl.[7] ..... F21V 33/00

[52] U.S. Cl. ..... 362/96; 416/5; 416/62; 416/146 R

[58] Field of Search ..... 362/96; 416/5, 416/62, 146 R

[56] References Cited

U.S. PATENT DOCUMENTS

| | | | |
|---|---|---|---|
| D. 329,285 | 9/1992 | Taylor, III | D23/413 |
| 4,832,572 | 5/1989 | Prucha et al. | 416/146 R |
| 5,110,261 | 5/1992 | Junkin | 416/204 R |
| 5,281,093 | 1/1994 | Sedlak et al. | 416/62 |
| 5,516,264 | 5/1996 | Anetrini | 416/62 |
| 5,564,900 | 10/1996 | McAuley | 416/62 |
| 5,591,005 | 1/1997 | McCready | 416/62 |
| 5,591,006 | 1/1997 | DeMeo et al. | 416/62 |
| 5,601,409 | 2/1997 | Huang | 416/229 R |
| 5,800,049 | 9/1998 | Todd, Jr. | 362/294 |

*Primary Examiner*—Stephen Husar
*Assistant Examiner*—Ronald E. Delgizzi
*Attorney, Agent, or Firm*—Blackwell Sanders Peper Martin

[57] ABSTRACT

A fan blade cover and strobe light for illuminating the same adapted for use with fan blades of ceiling fans and the like. The fan blade cover is a substantially rigid cover panel with dimensions corresponding to at least one major surface of a fan blade, and includes at least one member adapted for securing the cover panel to the fan blade surface in such a way as to cover the fan blade surface. The fan blade cover has at least one surface adapted for having designs, signage and other indicia thereon for illumination by a strobe light or lights. The cover panel can be constructed of materials such as, but not limited to, cardboard, poster board, fiber board, and other paper materials; solid and foamed plastics; and vinyl sheet material.

28 Claims, 4 Drawing Sheets

MULTI-FASTENING, ONE-PIECE, DECORATIVE FAN BLADE COVER AND STROBE LIGHT

This application claims the benefit of Barker U.S. Provisional Application No. 60/027,474 entitled FAN BLADE COVER AND STROBE UNIT filed Sep. 26, 1996.

FIELD OF THE INVENTION

This invention relates generally to covers for fan blades of ceiling fans and the like, and, more particularly, to a substantially rigid fan blade cover that can optionally be of one piece construction, which is adapted for displaying designs, signage and other indicia, and one or more strobe lights operable for illuminating the same.

BACKGROUND OF THE INVENTION

Fan blade covers of flexible fabric construction are well known. For example, reference U.S. Pat. No. 4,832,572, which shows a flexible stretch sock type fabric fan blade cover; and U.S. Pat. No. 5,281,093, which shows a flexible zipped sock type fabric fan blade cover. A problem that has been observed when using such known flexible and stretchable fan blade covers, however, is that they typically conform relatively closely to the shape of the fan blade, which sometimes makes the covers less distinct and noticeable. Also, when stretched to cover some fan blades, designs and other indicia on the flexible, stretchable covers can be stretched and deformed. Still further, the requirement of making the fan blade covers of fabric material with stretchability properties adds cost and limits the alternative materials that can be used.

Accordingly, a fan blade cover which overcomes one or more of the problems set forth above is sought.

SUMMARY OF THE INVENTION

According to one aspect of the present invention, a cover for a fan blade is disclosed, the present fan blade cover including a generally planar cover panel of substantially rigid construction having a sufficient size to cover at least a substantial portion of at least one major surface of the fan blade, and at least one member attached to the cover panel and positionable over at least a portion of an opposite surface of the fan blade for securing the cover panel in covering relation to the first named surface of the fan blade. The present fan blade cover can be made from a variety of materials such as, but not limited to, cardboard, poster board, fiber board, and other paper materials; solid and foamed plastics; and vinyl sheets. The at least one member for securing the cover panel in covering relation to the fan blade surface preferably includes one or more interlocking flaps attached along the edges of the cover panel and foldable over the fan blade; or flaps securable together using various fastener constructions such as hook and loop type fasteners, adhesive tapes and the like, to name just a few alternatives.

Additionally, the cover panel can include a wide variety of designs, signage and other indicia on the outwardly facing surface or surfaces thereof, such as advertising slogans and the like so as to be visible to one who glances at a fan on which one or more of the present covers is used. The designs can be printed or otherwised formed on the cover panel itself, or applied thereto using any suitable conventional means such as decals, appliques, stickers, silk screening, or the like.

According to another aspect of the present invention, one or more strobe lights can be provided for synchronized operation with a fan having one or more rotating blades covered by the present fan blade covers to allow better observation of designs, signage or other indicia located on the fan blade cover or covers. The strobe light or lights can be mounted on a fan itself and operable in cooperation with the fan, either alone or in conjunction with another light or lights mounted on the fan, or can be separate from the fan. Any conventionally constructed light capable of pulsed illumination to allow observation of designs, signage or indicia on the present fan blade cover or covers, while the fan is operating, with a desired visual effect can be used.

It is therefore an object of the present invention to provide an alternative fan blade cover construction usable with a wide variety of fan blades of different sizes and shapes.

It is another object of the invention to provide a fan blade cover adapted for carrying designs, signage and other indicia.

Still another object is to provide a fan blade cover that can have a shape and size which differs at least somewhat from the shape and size of a fan blade with which it is used.

It is a further object of the invention to provide a fan blade cover construction that can be made from material such as cardboard, plastics, vinyl sheeting, and the like, and which is adapted to have designs, signage and other indicia placed thereon using conventional printing means and the like.

It is another object of the invention to provide a fan blade cover that can be of one piece construction.

Another object is to provide a fan blade cover that is simple and easy to make and which is inexpensive.

Still another object is to provide means allowing illumination of designs, signage and other indicia on a rotating fan blade.

These and other objects and advantages of the present invention will become apparent to those skilled in the art after considering the following detailed specification of the present fan blade cover and strobe light for illuminating the same in conjunction with the accompanying drawings.

DESCRIPTION OF THE PREFERRED EMBODIMENTS

Figure 1:
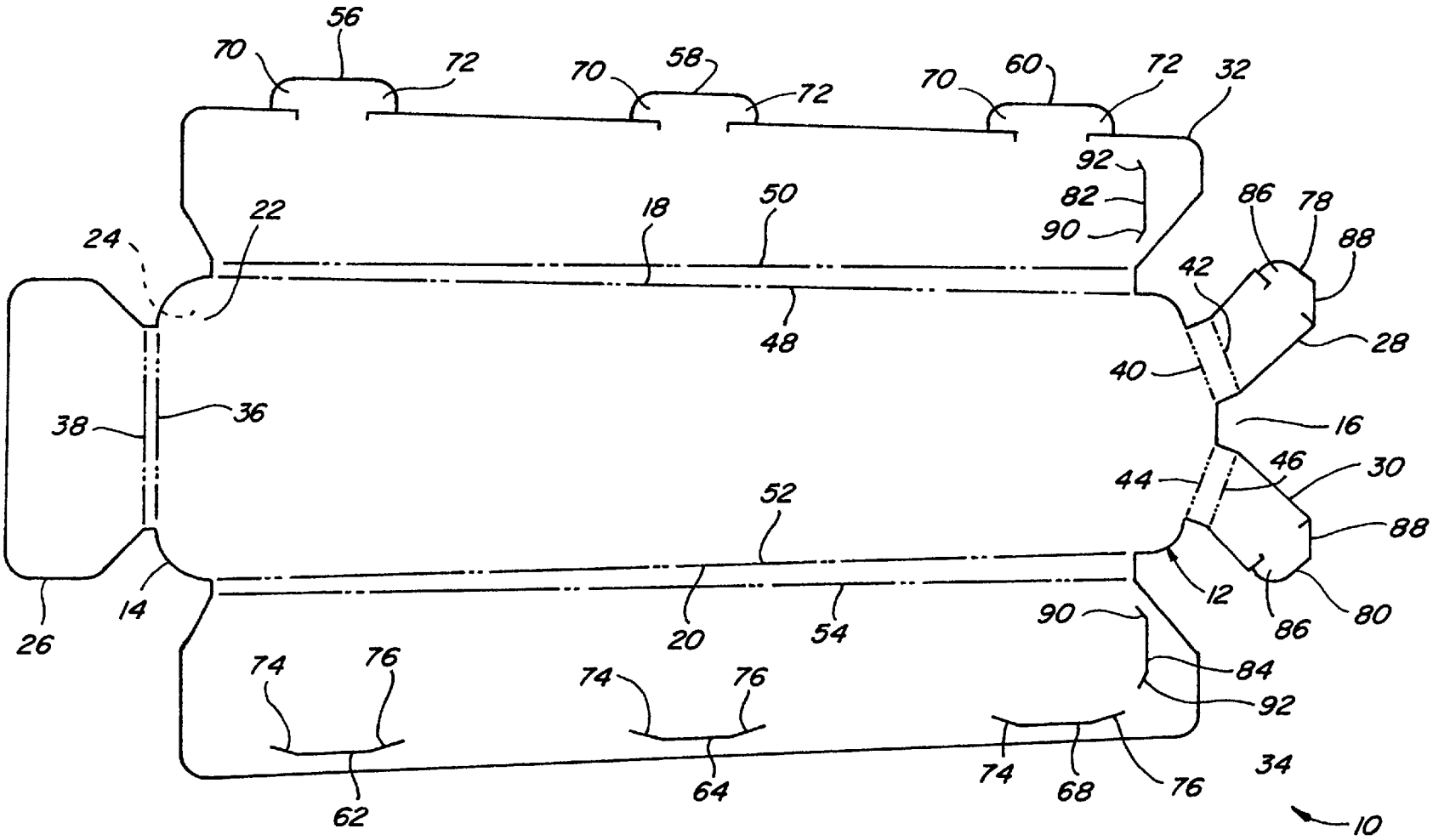
FIG. 1 is a bottom view of a fan blade cover embodiment constructed according to the present invention.

Referring to the drawings, more particularly by reference numbers, wherein like numerals refer to like parts, FIG. 1 shows a fan blade cover 10 according to the present invention. Fan blade cover 10 is a foldable member that can be made of any suitable substantially rigid material such as cardboard, poster board, fiber board and other fibrous materials; plastic sheet material and foamed board or the like. Fan blade cover 10 includes an elongated central cover panel 12 having a first longitudinal end portion 14 and an opposite second longitudinal end portion 16, a first longitudinally extending side edge portion 18, and an opposite second longitudinally extending side edge portion 20. First and second longitudinally extending side edge portions 18 and 20 are not parallel, but instead taper slightly so as to extend convergingly in the direction of second end portion 16 of cover panel 12 such that the cover panel can more closely conform in shape to a major surface of a wide variety of commercially available fan blades which have similarly tapered edge portions. Here, it should be recognized that although side edge portions 18 and 20 are shown as being tapered, they can likewise be more generally parallel with equal utility for more closely conforming to the major surfaces of commercially available fan blades having parallel side edge portions. Cover panel 12 further includes opposite surface portions including a bottom surface portion 22 which is intended to be visible to observers when fan blade cover 10 is installed on a fan blade, and a top surface portion 24 which will be located in abutting relation to the covered surface of the fan blade, as will be discussed. Bottom surface 22 of cover panel 12 can include a wide variety of designs, signage and other indicia thereon (not shown) which will be visible to persons who look at the fan as will also be explained.

Fan blade cover 10 includes a plurality of flaps for securing cover panel 12 in covering relation to a surface of a fan blade, typically the bottom or more downwardly facing major surface of the blade, including a first end flap 26 attached to first end portion 14 of cover panel 12; second and third end flaps 28 and 30 attached to second end portion 16; and first and second side flaps 32 and 34, attached respectively to first longitudinally extending side edge portion 18 and second longitudinally extending side edge portion 20. Flaps 26, 28, 30, 32 and 34 are preferably integrally formed with cover panel 12, but alternatively could be separate members attached thereto using suitable means such as fasteners or adhesives. First end flap 26 includes a pair of spaced, parallel folding lines 36 and 38 along its juncture with first end portion 14 of cover panel 12 to allow folding first end flap 26 over the end of a fan blade. Similarly, second end flap 28 includes spaced parallel folding lines 40 and 42 along its juncture with second end portion 16 of cover panel 12; third end flap 30 includes spaced, parallel folding lines 44 and 46 along its juncture with second end portion 16; and side flaps 32 and 34 include folding lines 48 and 50, and 52 and 54, respectively, along their junctures with side edges 18 and 20 of cover panel 12, to allow folding of flaps 28, 30, 32 and 34 over a fan blade, as will be shown. Note here that second and third end flaps 28 and 30 are spaced apart, and that the respective folding lines 40 and 42, and 44 and 46, thereof are spaced apart a greater distance than folding lines 36 and 38 of first end flap 26. This is to allow accommodation of a fan blade mounting arm typically associated with the mounting end of a fan blade, as will also be shown. Still further in this regard, note that folding lines 48 and 50, and 52 and 54, are respectively spaced apart a greater distance adjacent second end portion 16 of cover panel 12 compared to adjacent first end portion 14. This is also to provide a greater space adjacent second end portion 16 of the cover panel for accommodating the fan blade mounting arm, as also will be shown. To secure first end flap 26, second and third end flaps 28 and 30 and side flaps 32 and 34 in position atop a fan blade, flaps 28, 30, 32 and 34 include interlocking portions and flap 26 is positionable under flaps 32 and 34. The interlocking portions include tabs 56, 58 and 60 on first side flap 32 which are cooperatively receivable in slits 62, 64, and 68 in second side flap 34, respectively, each tab, 56, 58 and 60 having slitted ears 70 and 72 cooperatively engageable with portions of second side flap 34 adjacent angled ends 74 and 76 of the respective slits 62, 64 and 68 for retaining tabs 56, 58 and 60 in slits 62, 64 and 68. Similarly, second and third end flaps 28 and 30 include respective tabs 78 and 80 cooperatively receivable in slits 82 and 84 in first and second side flaps 32 and 34, the tabs 78 and 80 each including slitted ears 86 and 88 which interlock with side flaps 32 and 34 adjacent angled ends 90 and 92 of slits 82 and 84, respectively, for retaining the tabs in the slits.

Figure 2:
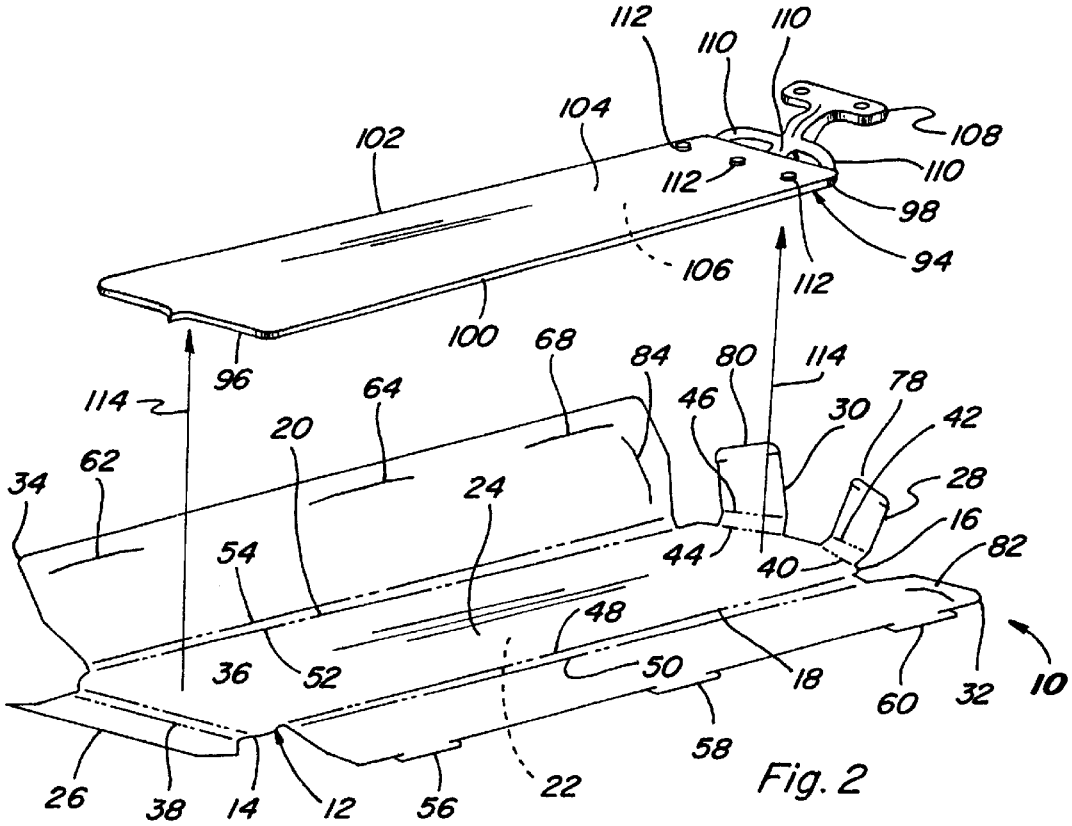
FIG. 2 is a perspective view showing installation of the fan blade cover of FIGS. 1 on a typical prior art fan blade.

Referring to FIG. 2, fan blade cover 10 is shown positioned for installation on a typical prior art fan blade 94. Fan blade 94 includes an elongated blade portion having a first blade end 96, an opposite second blade end 98 and first and second longitudinally extending side edges 100 and 102 extending between ends 96 and 98. Fan blade 94 further has opposite top and bottom major surfaces 104 and 106 extending between blade ends 96 and 98 and side edges 100 and 102, and a mounting arm 108 attached to second blade end 98 for mounting fan blade 94 to a fan in the conventional manner using screws or other mechanical fasteners. Note here that mounting arm 108 includes a plurality of fingers 110 attached to fan blade 94 with screws 112, also in the conventional manner.

Fan blade cover 10 is positioned for attachment to fan blade 94 with top surface 24 facing upwardly towards major bottom surface 106 of the fan blade, such that bottom surface 22 of the panel faces downwardly, which provides the desired visibility when cover 10 is mounted on blade 94 which is shown here in its operational orientation with top major surface 104 facing upwardly and bottom major surface 106 facing downwardly. Arrows 114 depict installation of fan blade cover 10 on fan blade 94 to position top surface 24 of the cover panel 12 in abutting covering relation with bottom major surface 106 of fan blade 98. With cover panel 12 in this position, first end flap 26 is foldable along folding lines 36 and 38 over first blade end 96 so as to be positioned in abutting covering relation to the adjacent portion of top surface 104 of the fan blade. Second side flap 34 is then foldable along folding lines 52 and 54 over second longitudinally extending side edge 102 of fan blade 98 so as to be positioned in abutting, covering relation to the adjacent portion of top surface 104 of the fan blade, and also a portion of first end flap 26. First side flap 32 is likewise foldable along folding lines 48 and 50 into abutting, covering relation to a portion of top surface 104 of the fan blade adjacent first longitudinally extending side edge 100 and the remaining portion of first end flap 26, tabs 56, 58 and 60 being insertable into slits 62, 64 and 68, respectively, to interlock side flaps 32 and 34 together. Likewise, second and third end flaps 28 and 30 are foldable along folding lines 40 and 42, and 44 and 46, respectively, over the adjacent portions of first and second side flaps 32 and 34, and tabs 78 and 80 are insertable into slits 82 and 84 so as to interlock tabs 78 and 80 with side flaps 32 and 34, the second and third end flaps 28 and 30 now being in partial covering relation to respective mounting fingers 110 of mounting arm 108.

Figure 3:
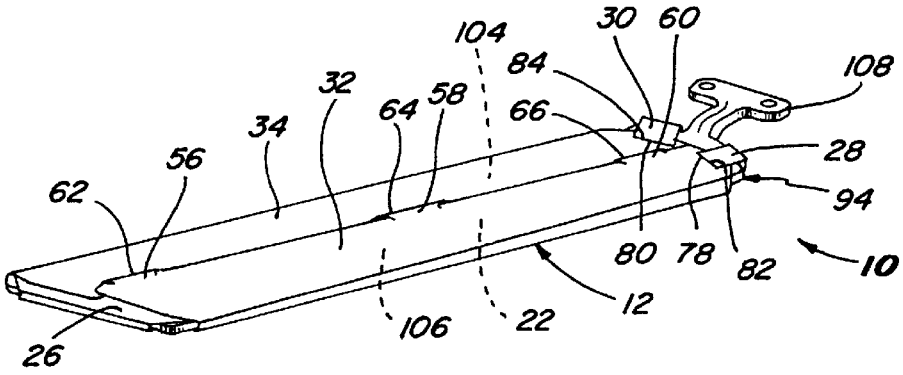
FIG. 3 is another perspective view showing the fan blade cover of FIGS. 1 and 2 installed on the fan blade.

FIG. 3 shows fan blade cover 10 fully installed on fan blade 94 with bottom surface 22 of cover panel 12 facing in the desired downward orientation, first end flap 26 tucked under first and second side flaps 32 and 34 which are interlocked by the cooperative receipt of tabs 56, 58 and 60 in the respective slits 62, 64 and 66, and tabs 78 and 80 of second and third end flaps 28 and 30 cooperatively received in respective slits 82 and 84. When installed in this way, bottom surface portion 22 of cover panel 12 provides a planar, highly visible surface for designs, signage and other indicia (not shown). Here it should be noted that the greater spaced relation between folding lines 40 and 42 and folding lines 44 and 46 of the respective second and third end flaps 28 and 30, the tapered relation of folding lines 48 and 50 and 52 and 54, as shown in FIG. 1, provides the necessary clearance between top surface portion 24 of cover panel 12 and bottom surface 106 of fan blade 94 for receiving mounting fingers 110 of mounting arm 108 without significant binding or other deformation of cover panel 12 (not shown). It should also be appreciated that various other arrangements for securing fan blade cover 10 to fan blade 94 can be used.

Figure 4:
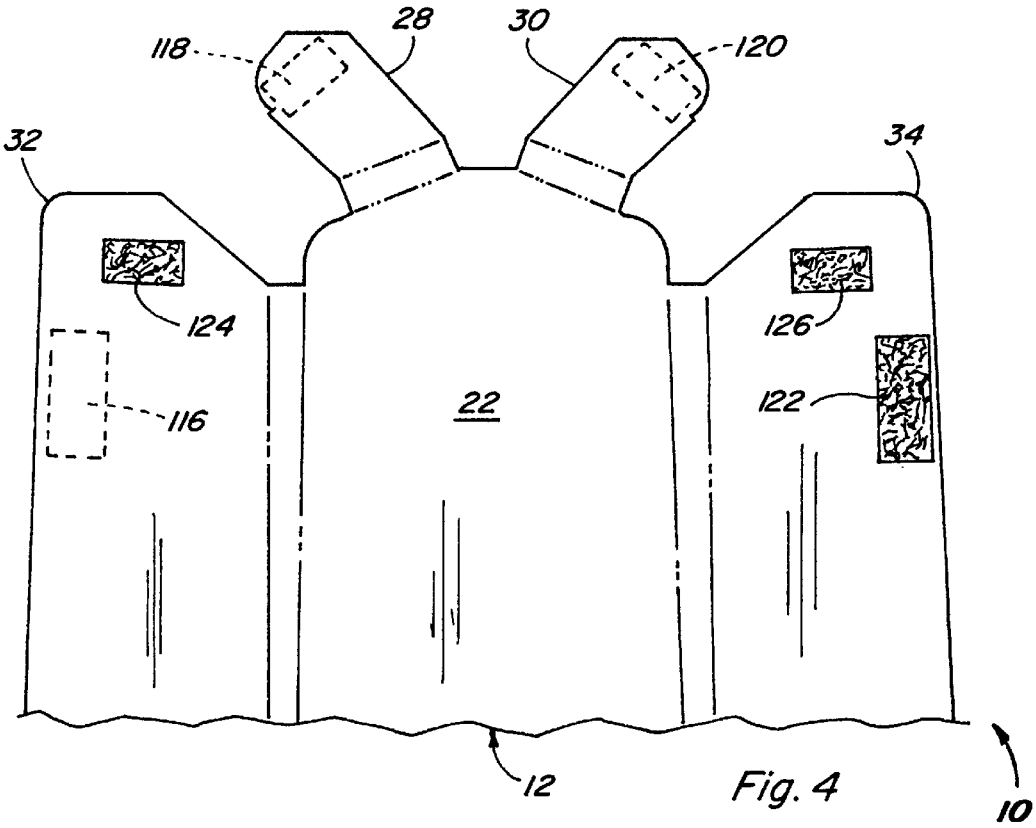
FIG. 4 is a fragmentary bottom view of the fan blade cover of FIG. 1, including alternative hook and loop fasteners for securing the fan blade cover to a fan blade.

With reference to FIG. 4, fan blade cover 10 is shown including hook and loop fasteners for securing first and second flaps 32 and 34 together, along with second and third end flaps 28 and 30. Here, first side flap 32 and second and third end flaps 28 and 30 include hook portions 116, 118 and 120, respectively, which are cooperatively engageable with loop portions 122, 124 and 126 of the fasteners which are located at corresponding positions on the flaps for securing, cover 10 on a fan blade such as the fan blade 94 in the manner shown in FIG. 3 with bottom surface 22 visible. Here, it should be recognized that additional hook and loop fasteners can be utilized at addition locations on the respective flaps to provide more secure attachment of cover 10 on a fan blade, as desired.

Figure 5:
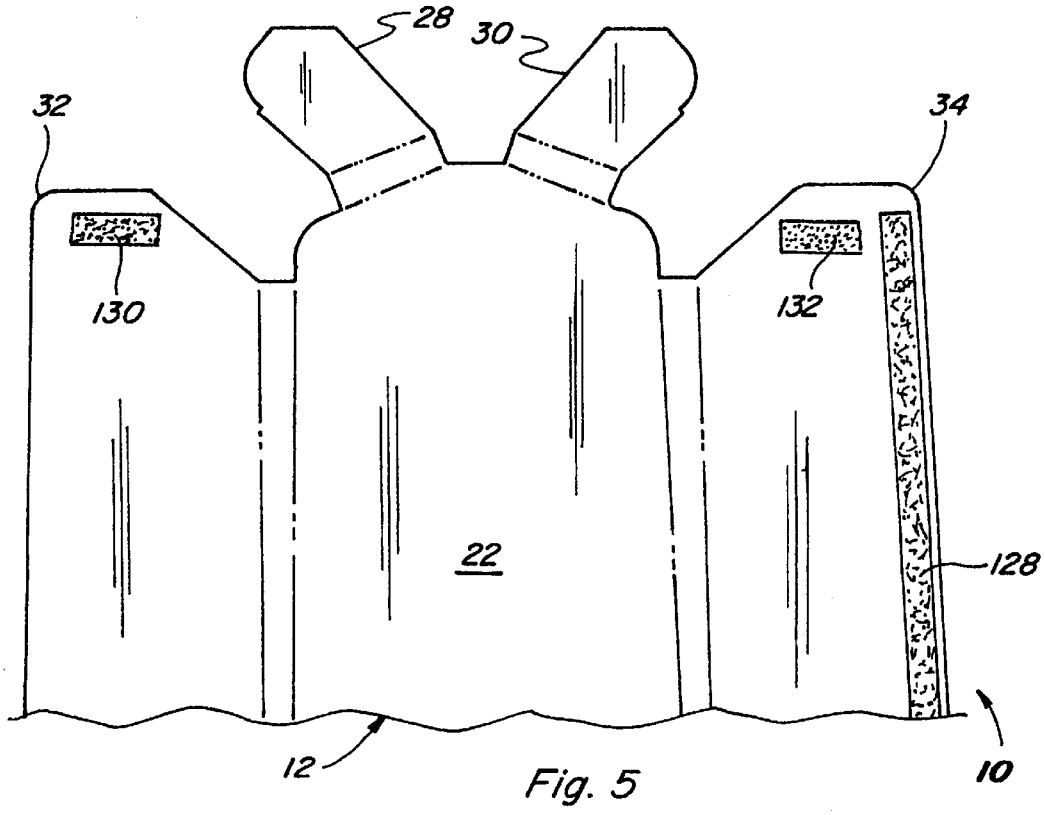
FIG. 5 is a fragmentary bottom view of the fan blade cover of FIG. 1, including two-sided adhesive tape for securing, the cover to a fan blade.

Somewhat similarly, FIG. 5 shows fan blade cover 10 with still different members for secure attachment on a fan blade such as the fan blade 94 with bottom surface 22 of cover panel 12 in the desired downwardly facing orientation. Here, a two-sided adhesive tape strip 128 extending longitudinally along second side flap 34 is adherable to first side flap 32 when the side flaps are folded in the above described manner with reference to FIG. 3, side flaps 32 and 34 also including two-sided adhesive tape strips 130 and 132, respectively, for the attachment of second and third end flaps 28 and 30 thereto when folded as described above with references to FIG. 3. It should be again noted that it is contemplated that a wide variety of members can be used for fastening fan blade cover 10 to a fan blade such as the fan blade 94, including transposition of the various interlocking and fastening members described above. Further, a fewer number, or a greater number, of the various interlocking and fastening members can likewise be used, as long as the desired object of positioning cover panel 12 in generally covering, and abutting relation to the bottom surface of a fan blade with the bottom surface 22 in the desired generally downwardly facing orientation is achieved.

As noted hereinbefore, the present fan blade cover can be used in association with one or more strobe lights operable for illuminating any design, signage or other indicia on the bottom surface of the cover panel of the fan blade cover. Such one or more strobe lights are contemplated to be of conventional commercially available construction and can optionally include electrical circuitry allowing operation of the lights for selectively "freezing" the fan blades in action to allow the designs, etc. on the cover panel bottom surface to be more easily read while the fan is in motion to thereby increase the effectiveness of the presence of the design, etc. in drawing attention. It is contemplated that the strobe light or lights can be mounted to the central hub of a fan (not shown) such as a conventional commercially available ceiling fan, either in place of a conventional lighting kit widely available for such fans, or in conjunction with such a lighting kit. Alternatively, the strobe light or lights could be provided separately from the fan.

Figure 6:
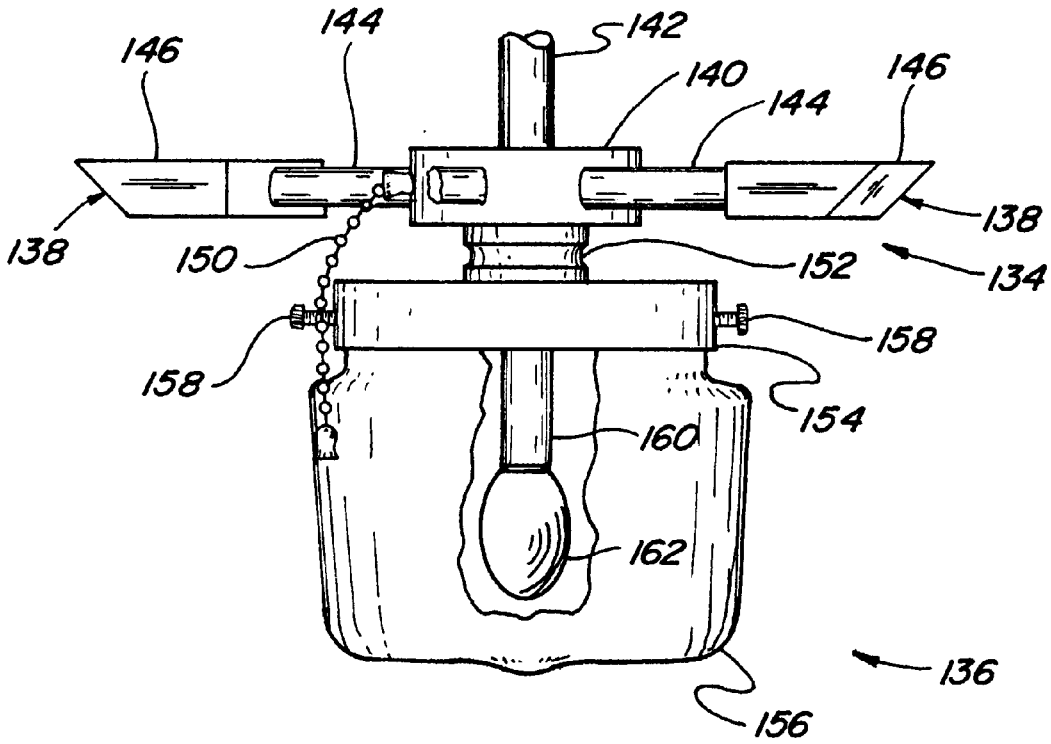
FIG. 6 is a partial fragmentary side view of a strobe light arrangement for illuminating the fan blade cover of the present invention in conjunction with a typical prior art light for a ceiling fan.
Figure 7:
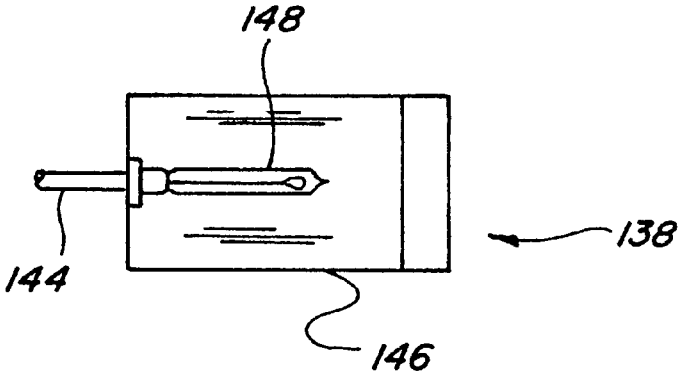
FIG. 7 is a top view of a strobe light unit of the arrangement of FIG. 6.

FIG. 6 shows a strobe light arrangement 134 according to the present invention in conjunction with a conventional ceiling fan light kit 136. Strobe light arrangement 134 is a multiple strobe light assembly including strobe light units 138 located at spaced intervals around a central hub 140. A mounting tube 142 extends upwardly from central hub 140 and is adapted for attachment to a central hub of a typical commercially available ceiling fan in the conventional manner (not shown). Mounting tube 142 has a central passage therethrough adapted to serve as a conduit for wires carrying electricity from a ceiling fan to which the tube is mounted to central hub 140. Each strobe light unit 138 includes a connecting tube 144 connected to central hub 140 and adapted for the passage of wires carrying electricity to the respective strobe light units 138, each unit further including an upwardly open reflector 146 connected to connecting tube 144, each reflector 146 being a tray shaped member containing a flash tube 148 (FIG. 7). Using strobe light units 138, light emitted by the flashing tubes 148 is reflected upwardly by reflectors 146 to illuminate the bottom surface or surfaces of cover panels of fan blade covers located on the blades of a fan which are located above strobe light arrangement 134 (not shown). Central hub 140 can additionally contain electronic circuitry for illuminating the flash tubes 148 at a desired frequency, apparatus and circuitry to allow adjusting the frequency, and a switch for energizing and de-energizing the lights, including a pull chain 150 or other suitable apparatus for doing so.

Ceiling fan light 136 is of conventional commercially available construction including a connector 152 for attachment to central hub 140, a base plate 154 supporting a translucent globe 156 using thumb screws 158 and a mounting base 160 for an incandescent light bulb 162, all of the components of ceiling fan light 136 being operable in the conventional manner.

FIG. 7 shows a typical strobe light unit 138 including upwardly directed reflector 146 containing flash tube 148 and connecting tube 144 for the passage of wires carrying electricity to flash tube 148. Here again, it should be recognized that the strobe light arrangement can alternatively include only a single strobe light and can be used either alone, or in combination with conventional lights for ceiling fans.

Thus, there has been shown and described several embodiments of a novel fan blade cover and strobe light for illuminating the same according to the present invention, which embodiments fulfill all of the objects and advantages sought therefor. Many changes, modifications, variations and other uses and applications of the present fan blade cover and strobe light will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A cover for a surface of a fan blade of a ceiling fan comprising:

a substantially planar, one-piece cover panel made of substantially rigid material having a size and shape corresponding at least generally to the known size and shape of the fan blade surface and adapted to be positioned in covering relation thereto, said panel having a plurality of members which are extendable over at least a portion of an opposite fan blade surface for securing the panel in covering relation to the first named fan blade surface.

2. The cover, as set forth in claim 1, wherein the plurality of members for securing the panel in covering relation to the surface of said fan blade comprises a plurality of interlocking flaps.

3. The cover, as set forth in claim 1, wherein the plurality of members for securing the panel in covering relation to the surface of said fan blade comprises a plurality of flaps having adhesively engageable surfaces.

4. The cover, as set forth in claim 1, wherein the plurality of members for securing the panel in covering relation to the surface of said fan blade comprises a plurality of flaps having hook and loop fasteners disposed respectively thereon.

5. The cover, as set forth in claim 1, wherein the cover panel has a bottom surface portion adapted for the placement of designs, signage and indicia thereon.

6. The cover, as set forth in claim 1, wherein at least the cover panel is made from a fibrous material selected from the group consisting of cardboard, poster board and fiber board.

7. The cover, as set forth in claim 1, wherein at least the cover panel is made from a material selected from the group consisting of solid plastic sheet and foamed plastic sheet.

8. The cover, as set forth in claim 1, wherein at least the cover panel member is made from a vinyl sheet material.

9. A cover, as set forth in claim 5, wherein the ceiling fan includes a central hub, said cover further comprising at least one strobe light for illuminating the cover panel, said at least one strobe light being mounted to the central hub of the ceiling fan in such a way to allow for said strobe light to illuminate the bottom surface portion of said cover panel.

10. The cover, as set forth in claim 9, wherein said at least one strobe light further comprises at least one reflector for reflecting light from the at least one strobe light towards the bottom surface of said cover panel.

11. The cover, as set forth in claim 9, wherein the central hub of the ceiling fan includes apparatus and circuitry for operating the at least one strobe light in synchronization with rotation of the fan blade of the ceiling fan.

12. A fan blade cover adapted to be mounted in substantially covering relation to at least one major surface of a fan blade of a ceiling fan having an approximately known size and shape, the fan blade cover comprising:

a generally planar, one-piece cover panel of substantially rigid construction, the cover panel having a size and shape corresponding at least substantially to the size and shape of the at least one major surface of the fan blade and adapted to be positionable in covering relation thereto, and a plurality of members attached to the cover panel and positioned over another major surface of the fan blade for securing the cover panel in substantially covering relation to the at least one major surface of the fan blade.

13. The fan blade cover, as set forth in claim 12, wherein the plurality of members for securing the cover panel in substantially covering relation to the at least one major surface of the fan blade comprises a plurality of flaps attached to opposite edges of the cover panel, said flaps being foldable over an opposite major surface of the fan blade and each including means for engaging at least one other flap.

14. The fan blade cover, as set forth in claim 12, wherein the cover panel has a surface portion which is visible when the cover panel is located in covering relation to the major fan blade surface, which surface portion is adapted to receive design, signage, and other indicia.

15. The fan blade cover, as set forth in claim 12, wherein at least the cover panel is made from a fibrous material selected from the group consisting of cardboard, poster board and fiber board.

16. The fan blade cover, as set forth in claim 12, wherein at least the cover panel is made from a material selected from the group consisting of solid plastic sheet and foamed plastic sheet.

17. The fan blade cover, as set forth in claim 12, wherein at least the cover panel member is made from a vinyl sheet material.

18. The fan blade cover, as set forth in claim 12, wherein said cover includes at least a bottom surface and wherein the ceiling fan includes a central hub, said cover further comprising at least one strobe light for illuminating the cover panel, said at least one strobe light being mounted to the central hub of the ceiling fan in such a way to allow for said strobe light to illuminate the bottom surface of said cover panel.

19. The fan blade cover, as set forth in claim 18, wherein said at least one strobe light further comprises at least one reflector for reflecting light from the at least one strobe light towards the bottom surface of said cover panel.

20. The fan blade cover, as set forth in claim 18, wherein the central hub of the ceiling fan includes apparatus and circuitry for operating the at least one strobe light in synchronization with rotation of the fan blade of the ceiling fan.

21. A fan blade cover and strobe light assembly adapted to be mounted to a ceiling fan having at least one fan blade and a central hub, the fan blade having top and bottom surfaces, the assembly comprising:

a generally planar, one-piece fan blade cover panel of substantially rigid construction, the cover panel having a size and shape corresponding at least substantially to the size and shape of at least the bottom surface of the fan blade and adapted to be positionable in covering relation thereto;

a plurality of members attached to the cover panel and positioned over the top surface of the fan blade for securing the cover panel in substantially covering relation to at least the bottom surface of the fan blade; and at least one strobe light for illuminating the cover panel, said strobe light being mounted to the central hub of the ceiling fan in such a way to allow for said strobe light to illuminate the bottom surface of said cover panel.

22. The assembly, as set forth in claim 21, wherein the plurality of members for securing the cover panel in substantially covering relation to at least the bottom surface of the fan blade comprises a plurality of flaps attached to opposite edges of the cover panel, said flaps being foldable over the top surface of the fan blade and each including means for engaging at least one other flap.

23. The assembly, as set forth in claim 21, wherein the bottom surface of the cover panel is adapted to receive a design, signage, or other indicia.

24. The assembly, as set forth in claim 21, wherein the cover panel is made from a fibrous material selected from the group consisting of cardboard, poster board and fiber board.

25. The assembly, as set forth in claim 21, wherein the cover panel is made from a material selected from the group consisting of solid plastic sheet and foamed plastic sheet.

26. The assembly, as set forth in claim 21, wherein the cover panel member is made from a vinyl sheet material.

27. The assembly, as set forth in claim 21, wherein said at least one strobe light further comprises at least one reflector for reflecting light from the at least one strobe light towards the bottom surface of said cover panel.

28. The assembly, as set forth in claim 21, wherein the central hub of the ceiling fan includes apparatus and circuitry for operating the at least one strobe light in synchronization with rotation of the fan blade of the ceiling fan.

* * * * *